US006641091B1

(12) United States Patent
Hilleary

(10) Patent No.: US 6,641,091 B1
(45) Date of Patent: Nov. 4, 2003

(54) HIGHWAY RAILROAD CROSSING VEHICLE DETECTION METHODS AND SYSTEMS

(75) Inventor: Thomas N. Hilleary, Chesterfield, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/005,231

(22) Filed: Dec. 3, 2001

Related U.S. Application Data

(63) Continuation-in-part of application No. 09/584,865, filed on Jun. 1, 2000, now Pat. No. 6,340,139.

(51) Int. Cl.[7] ..... B61L 29/00

(52) U.S. Cl. ..... 246/473.1; 246/111; 701/202; 340/825.49

(58) Field of Search ..... 246/111, 113, 246/114 R, 473.1, 477; 701/202, 209; 342/457; 340/825.49, 539

(56) References Cited

U.S. PATENT DOCUMENTS 4,876,527 A * 10/1989 Oka et al. ..... 340/441
5,006,978 A * 4/1991 Neches ..... 709/102
5,519,400 A 5/1996 McEwan
5,559,469 A * 9/1996 Smith ..... 330/123
5,559,496 A * 9/1996 Dubats ..... 340/539.26
5,572,450 A * 11/1996 Worthy ..... 702/85
5,729,213 A * 3/1998 Ferrari et al. ..... 340/901
5,764,162 A * 6/1998 Ehrlich ..... 340/933
5,831,669 A 11/1998 Adrain
5,889,474 A * 3/1999 LaDue ..... 340/825.49
5,899,474 A * 5/1999 Grutzik ..... 280/229
6,219,613 B1 * 4/2001 Terrier et al. ..... 701/207
6,263,437 B1 * 7/2001 Liao et al. ..... 713/169
6,345,233 B1 * 2/2002 Erick ..... 701/301
6,405,106 B1 * 6/2002 Sheth et al. ..... 701/1
6,411,958 B1 * 6/2002 Dijkstra ..... 707/101

* cited by examiner

*Primary Examiner*—S. Joseph Morano
*Assistant Examiner*—Frantz F. Jules
(74) *Attorney, Agent, or Firm*—Carl A. Rowold, Esq.; Armstong Teasdale LLP

(57) ABSTRACT

In one embodiment, the a method for collecting railroad crossing data is disclosed. The method includes detecting a presence of at least one of pedestrians and vehicles within a boundary of the railroad crossing, storing a count of the presence of pedestrians and vehicles detected within the boundary and transmitting the count to an external device.

38 Claims, 13 Drawing Sheets

Major Components of the Cellular Telephone Network

Wireless Data Technology Options

HIGHWAY RAILROAD CROSSING VEHICLE DETECTION METHODS AND SYSTEMS

CROSS REFERENCE TO RELATED APPLICATION

This application is a continuation-in-part of U.S. patent application Ser. No. 09/584,865, filed Jun. 1, 2000now U.S. Pat. No. 6,340,139, which is incorporated herein by reference.

BACKGROUND OF THE INVENTION

This invention relates generally to detecting a location of a vehicle, and more particularly to detecting the presence of a vehicle in a railroad crossing.

Train-vehicle accidents may occur at railroad crossings when drivers ignore or do not observe warning systems such as gates, flashing lights, or warning signs. The railroad industry and state transportation authorities regularly engage in construction projects to increase safety at these crossings, particularly drawing on accident statistics for prioritizing potential projects.

Previous attempts for accomplishing the increase in safety have been hindered by the cost and lack of precision of detection technologies such as infrared, light beams and photocells, and microwave security intrusion sensors. The accuracy of these technologies can vary widely over time, temperature, and weather conditions. Ice, snow, rain, and dust can render them inoperative.

Buried impedance loop systems are used at some railroad crossings. Impedance loops are buried under the crossing and are connected to a monitoring device that can control the raising and lowering of gates at a rail crossing. The presence of a vehicle within the crossing causes an impedance within the buried loop circuit to change, the impedance change being detected by the monitoring device, which then causes the gates to open, allowing the vehicle to exit. Drawbacks to the buried impedance loop systems include that while the system can detect vehicles, the system does not detect pedestrian traffic. In addition, buried impedance loop systems are costly to install and maintain.

BRIEF SUMMARY OF THE INVENTION

In one aspect, a method for collecting railroad crossing data is provided. In an example embodiment, the method comprises detecting a presence of at least one of a pedestrian and a vehicle within a boundary of the railroad crossing, storing a count of the presence of pedestrians and vehicles detected within the boundary, and transmitting the count to an external device.

In another aspect, a railroad crossing system is provided. In an example embodiment, the system comprises at least one micropower impulse radar (MIR) unit configured to detect a presence of at least one of a pedestrian and a vehicle within a boundary of a railroad crossing, a remote terminal unit (RTU) coupled to the MIR unit and configured to store a count of the presence of pedestrians and vehicles detected within the boundary by the MIR unit and further configured to communicate the counts, and a computer system configured to receive the counts communicated by the RTU.

In still another aspect, a method for monitoring a plurality of railroad crossings is provided. In an example embodiment, the method comprises collecting railroad crossing data for each railroad crossing, storing the railroad crossing data, selecting a sorting criteria, and sorting the railroad crossing data using the selected sorting criteria.

In yet another aspect, a system is provided which comprises at least one computer and a plurality of micropower impulse radar (MIR) units. The MIR units are deployed at a plurality of railroad crossings, at least one MIR unit per railroad crossing. The MIR units deployed at each crossing are configured for detecting a presence of at least one of pedestrians and vehicles within a boundary of the railroad crossing where deployed. The system further includes a plurality of remote terminal units (RTUs), each of the MIR units connected to one of the RTUs. The RTUs are configured to store a count of the presence of pedestrians and vehicles detected within the boundary by said MIR units and further configured to communicate at least the counts to the computer. The computer is further configured to determine elevated risk railroad crossings based upon the counts received from the plurality of RTUs.

In another aspect, a railroad crossing system is provided which comprises at least one crossing gate arm, a number of impedance loops buried under the railroad crossing, and a gate control mechanism connected to the impedance loops and configured to raise the crossing gate arms upon detection of a vehicle within a boundary by the impedance loops. To augment the impedance loops and control mechanism, the system further comprises at least one micropower impulse radar (MIR) unit configured to detect vehicles within the boundary and at least one remote terminal unit (RTU) connected to the MIR units. The RTU is configured to communicate with the gate control mechanism.

In still another aspect, a method for detecting trapped vehicles within a railroad crossing is provided. The railroad crossing includes impedance loops buried under the crossing, within a crossing boundary, which are connected to a gate arm control mechanism, which is further connected to one or more gate arms. The railroad crossing further includes at least one micropower impulse radar (MIR) unit configured to detect vehicles within the boundary and at least one remote terminal unit (RTU) connected to the MIR units and further configured to communicate with the gate arm control mechanism. The method comprises lowering the gate arms upon approach of a train, thereby defining a boundary, checking for vehicles trapped within the boundary using the impedance loops and gate control mechanism and separately with the MIR units and the RTU, raising the gate arms if a vehicle is detected, repeatedly checking for vehicles until no vehicle is detected, and lowering the gate arms.

DETAILED DESCRIPTION OF THE INVENTION

Figure 1:
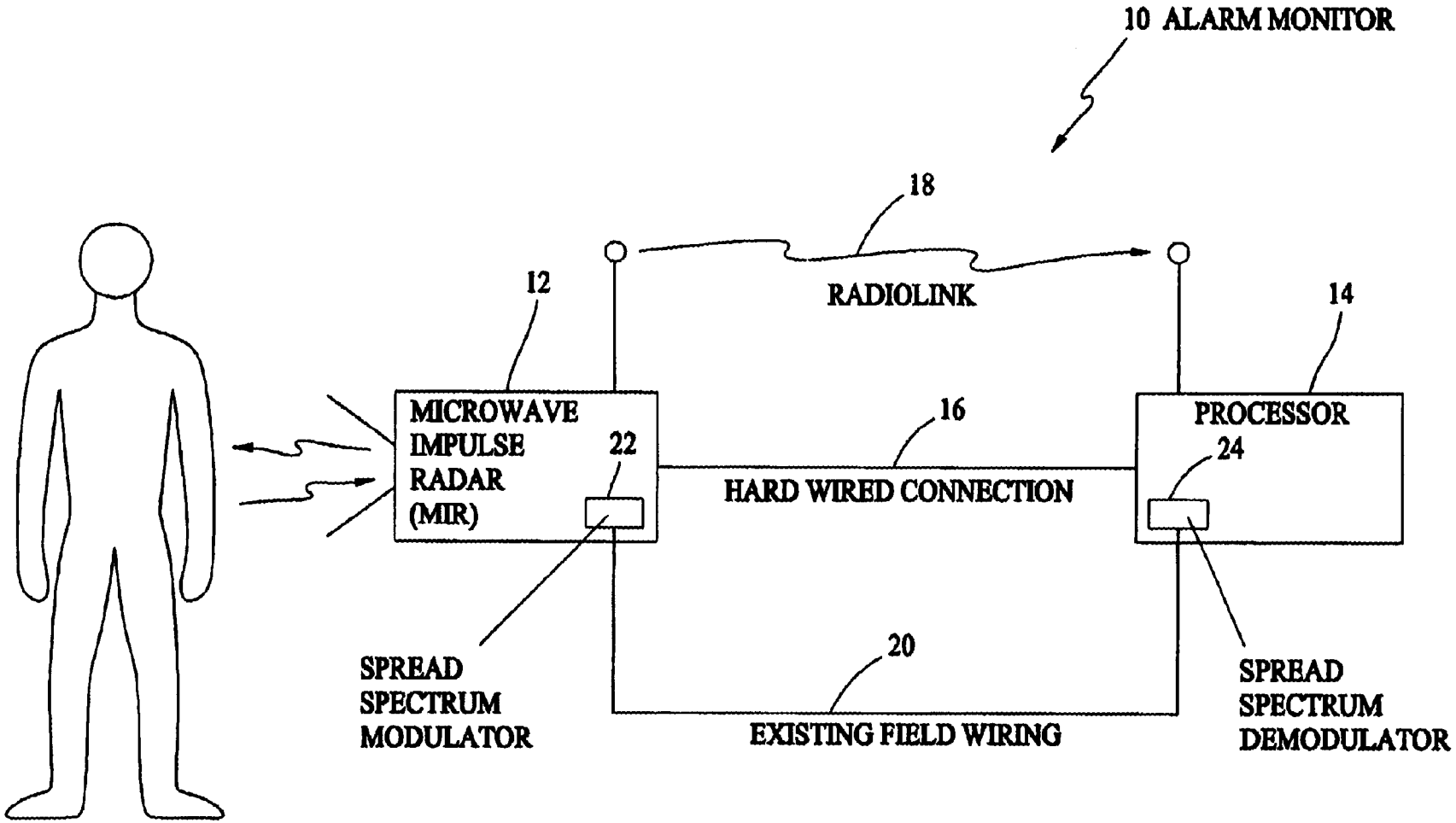
FIG. 1 is a block diagram of one embodiment of an alarm monitor.

FIG. 1 is a simplified block diagram of one embodiment of an alarm monitor 10. Alarm monitor 10 comprises at least one Micropower Impulse Radar (MIR) 12 that is responsive to pedestrians or vehicles in a boundary of a railroad crossing (not shown), the boundary being a region of the railroad crossing that is dangerous for a pedestrian or vehicle to occupy during approach and passage of a train. A MIR unit is a device that produces a short, low power microwave impulse and that has the capability of detecting reflections from objects within a limited distance range. One embodiment of such radars have the capability of detecting pedestrians and/or motor vehicles at a range of no more than about 30 feet (9 meters) due to power limitations of the radar unit itself. The range limitation is desired to reduce susceptibility to spurious signals outside of prohibited region. The limitation is also used to advantage in some embodiments to avoid reflections from the train itself, as it crosses the grade, and to avoid spurious indications due to animals that may enter a railroad crossing from directions other than the highway. One example of a suitable MIR unit 12 is an RRF24 Rangefinder, available from TEM Innovations, Pleasanton, Calif., which has a maximum range of about 20 meters, but which can be adjusted to detect in a more limited range. Another suitable MIR unit is described in U.S. Pat. No. 5,805,110, issued Sep. 8, 1998 to Thomas E. McEwan.

MIR units 12 are also configured to transmit detection data relating to pedestrians and vehicles in the boundary to a nearby processor 14. Transmission is via a hardwired connection 16, via a radio link 18, or via already existing field wiring 20. Although several transmission modes are shown in FIG. 1, only one is required in any particular embodiment. In one embodiment, a spread spectrum modulator 22, for example, an INTELLON® SSC P200 modulator/demodulator (available from Intellon, Inc., Ocala, Fla.) is utilized to modulate the detection signal before transmission over connection 16, radio link 18, or field wiring 20. In this embodiment, a spread spectrum demodulator 24 (for example, also an INTELLON® SSC P200 modulator/demodulator) is used to demodulate transmissions of detection data at processor 14. (Only field wiring link 20 is shown equipped with modulator 22 and demodulator 24 in FIG. 1.)

Figure 2:
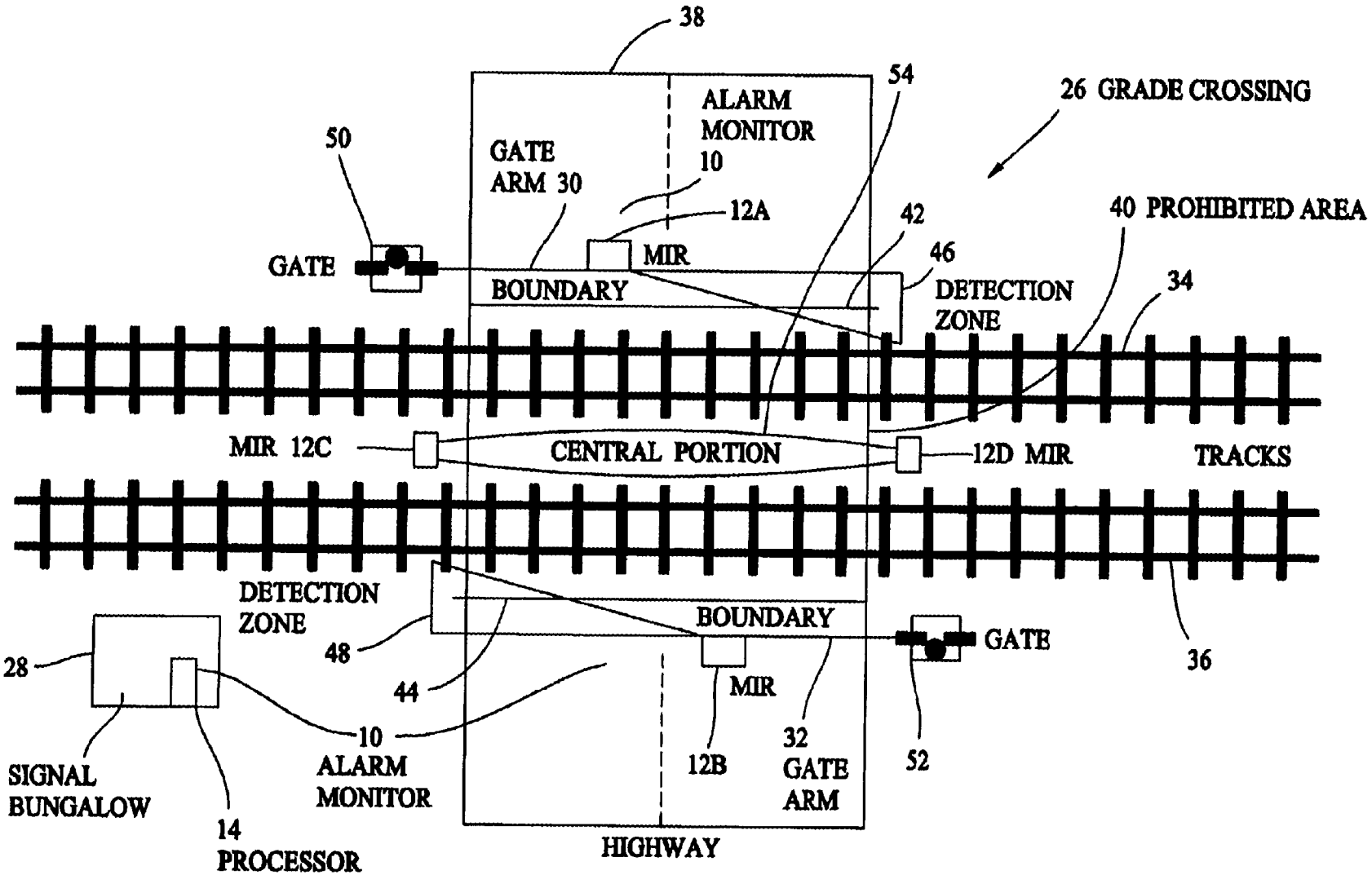
FIG. 2 is a simplified map of a railroad crossing having gate arms that drop to warn approaching vehicular and/or pedestrian traffic of an approaching train.

Various installations of embodiments of alarm monitor 10 in a railroad crossing 26 are illustrated in FIGS. 2 through 5. Referring to FIG. 2, railroad crossing 26 has a signal bungalow 28 containing equipment that activates gate arms 30, 32 when a train (not shown) on either of tracks 34 or 36 activates an island activation relay (not shown). This activation causes gate arms 30, 32 to drop, blocking oncoming traffic in both directions on highway 38. However, as a safety feature, each gate arm 30, 32 on a typical railroad crossing 26 only extend across a portion of highway 38. This safety feature allows a vehicle that has already entered a prohibited area 40 of railroad crossing 26 to continue through on their side of the road. However, the presence of this safety feature also allows an impatient pedestrian or vehicle driver to circumvent the signaling and protection afforded by gate arms 30, 32 by changing traffic lanes and going around the gate arms. Needless to say, this practice is dangerous.

In the embodiment of FIG. 2, MIR units 12A and 12B are mounted on ends of gate arms 30, 32. MIR units 12A and 12B are positioned on these arms so that, when gate arms 30 and 32 are lowered, MIR units 12A and 12B are directed to detect objects in a narrow region around boundaries 42, 44 of prohibited area 40 on highway 38 that are not blocked by gate arms 30, 32. MIR units 12A and 12B are energized when the island activation relay (not shown) is activated, and thus become responsive to pedestrians and vehicles improperly crossing boundaries 42 and 44 when gate arms 30 and 32 are lowered.

MIR units 12A and 12B provide an advantageous configuration in that they have a combination of a relatively limited range (e.g., no more than about 6 to 9 meters, or no more than about 20 to 30 feet) and a relatively precise zone of coverage (i.e., a relatively precise angular coverage). Thus, alarm system 10 defines rather sharply defined detection zones 46, 48 that are more resistant to spurious alarms and more sensitive to actual intrusions into prohibited area 40 from highway 38 than systems using standard microwave security intrusion sensors. Furthermore, the accuracy and repeatability using MIR units 12A and 12B is greater than that obtainable using standard microwave security intrusion sensors, or infrared and light beam/photocell sensors. Unlike these sensors, MIR units are resistant to ice, snow, rain, and dust that can render these other sensors inoperative. Also, unlike buried impedance loops (further described below), which are difficult to install and maintain, pedestrian (and bicycle) traffic is readily detected.

When intrusion into either zone 46 or 48 is detected, a detection data signal is transmitted to processor 14 inside signal bungalow 28. The transmission path is not shown in FIG. 2. However, as discussed in connection with FIG. 1, transmission is via a hardwired link, a radio link, or via field wires (not shown in FIG. 2, but shown in FIG. 1) that supply lights and gates 50, 52 with their electrical energy. In some embodiments, to ensure a metal path when transmission is via field wires, MIR units 12A and 12B contain additional circuitry to synchronize transmission of detection data with the presence of a flashing voltage on the field wires. Transmission via spread spectrum modulation, with repetitions of signals from MIR units 12A and 12B enable processor 14 in one embodiment to receive asynchronous transmissions from MIR units 12A and 12B.

In one embodiment, processor 14 makes a determination that railroad crossing 26 is active. This determination is made either directly in response to the activation of the island activation relay by an approaching train (not shown), or indirectly in response to such activation, such as by sensing activity of a flashing relay (not shown). When this determination is made, and during such times that the railroad crossing 26 is signaling that the train is approaching or crossing railroad crossing 26, when a signal indicating an intrusion is received from either MIR unit 12A or 12B, processor 14 generates a warning signal. In one embodiment, the generation of a warning signal is conditioned upon the activation of the island activation relay. Also in one embodiment, the warning signal and is used to control transmission of a signal intended for reception at a location remote from railroad crossing 26 to alert officials (and/or the train engineer) that a hazardous condition has just occurred. Also, the warning signal is used to increment a counter (not shown separately in FIG. 2) to keep track of the occurrences of such hazardous conditions. In one embodiment, the warning signal and the counter are both internal to processor 14 and are implemented using software or firmware. In this manner, processor 14 can be accessed at a later time to determine how many times hazardous attempts have been made to cross railroad crossing 26, and a decision made to further action taken to reduce such hazardous crossing attempts based upon the stored count.

In one embodiment, the violation detection capabilities of outer MIR units 12A and 12B are augmented by one or more additional central MIR units 12C, 12D positioned and directed to be responsive to pedestrians and vehicles only within a central portion 54 of prohibited area 40. Processor 14 receives detection data from the one or more central MIR units 12C, 12D and is configured to present its alarm signal only if a central MIR unit 12C and/or 12D detects the presence of a pedestrian or vehicle after an outer MIR unit 12A or 12B has detected the pedestrian or vehicle. This further requirement for an alarm indication further reduces false alarms that may occur when a vehicle or a pedestrian is detected only when leaving railroad crossing 26, or in the event a portion of vehicle or pedestrian grazes a detection zone 46 or 48 but does not cross either track 34 or 36. In one embodiment, such events are noted and recorded by processor 14, but are given a lower priority and/or are counted separately. Although central MIR units are illustrated in FIG. 2 in conjunction with an embodiment in which outer MIR units are mounted on gate arms, central MIR units are also used in other embodiments having outer MIR units having different mountings.

Figure 3:
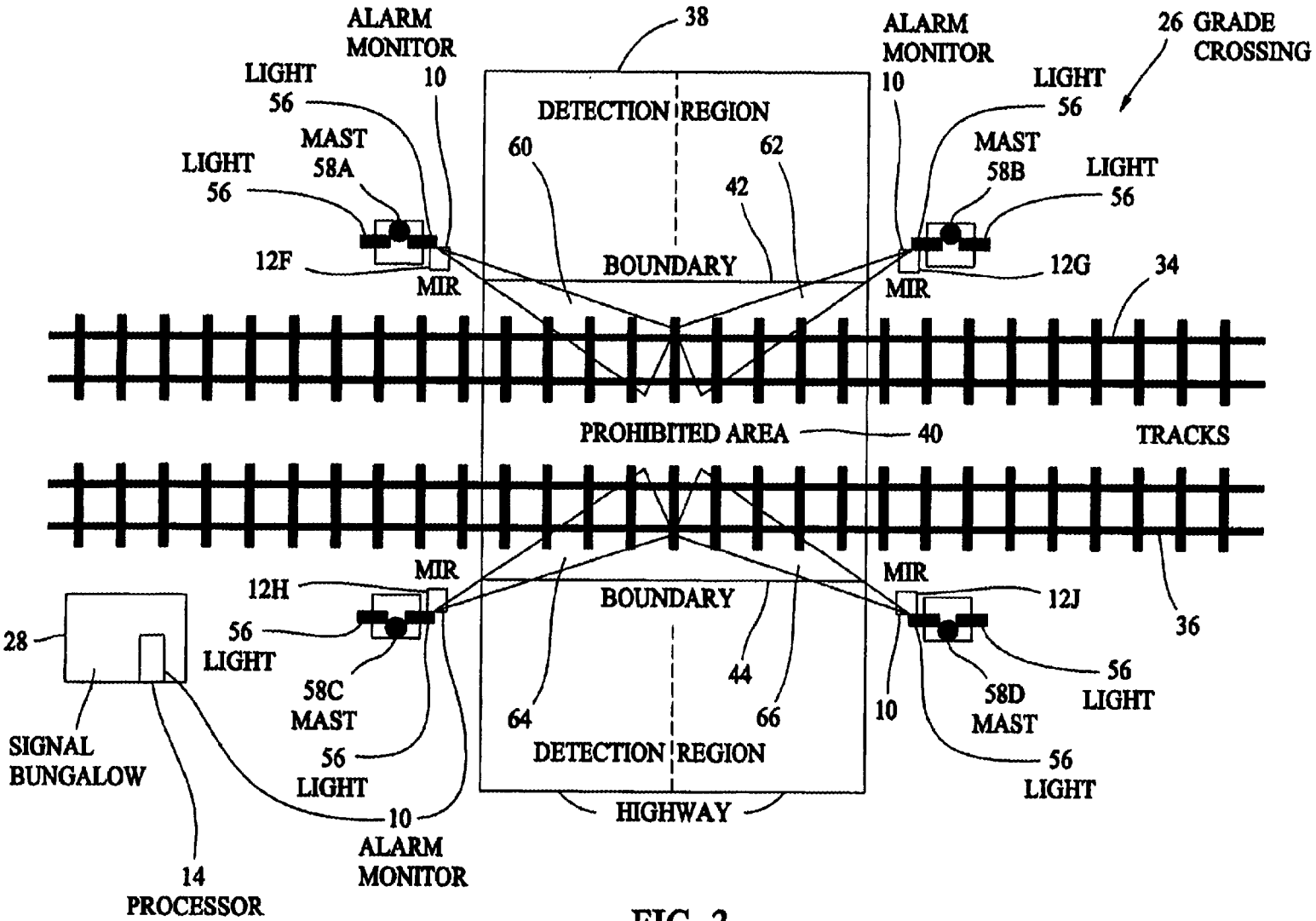
FIG. 3 is a map of a railroad crossing similar to that of FIG. 2, but without gate arms.

FIG. 3 is an illustration of an embodiment of alarm system 10 mounted on a railroad crossing 26 that does not use gates or gate arms. Instead, railroad crossing 26 signals the approach of a train by activating flashing lights 56 mounted on masts 58A, 58B, 58C and 58D that are located near corners of prohibited area 40. In this embodiment, MIR units 12F, 12G, 12H and 12J are mounted on masts 58A, 58B, 58C, and 58D, respectively, and are configured to detect pedestrians and vehicles in detection regions 60, 62, 64 and 66. Thus, MIR units 12F, 12G, 12H and 12J detect intrusions that occur by pedestrians and vehicles that cross a boundary of prohibited area 40 in a traffic lane nearby a corresponding mast 58A, 58B, 58C and 58D. As used herein, being "mounted on a mast" is not intended to exclude being mounted on one of the flashing lights 56 mounted on a mast.

Figure 4:
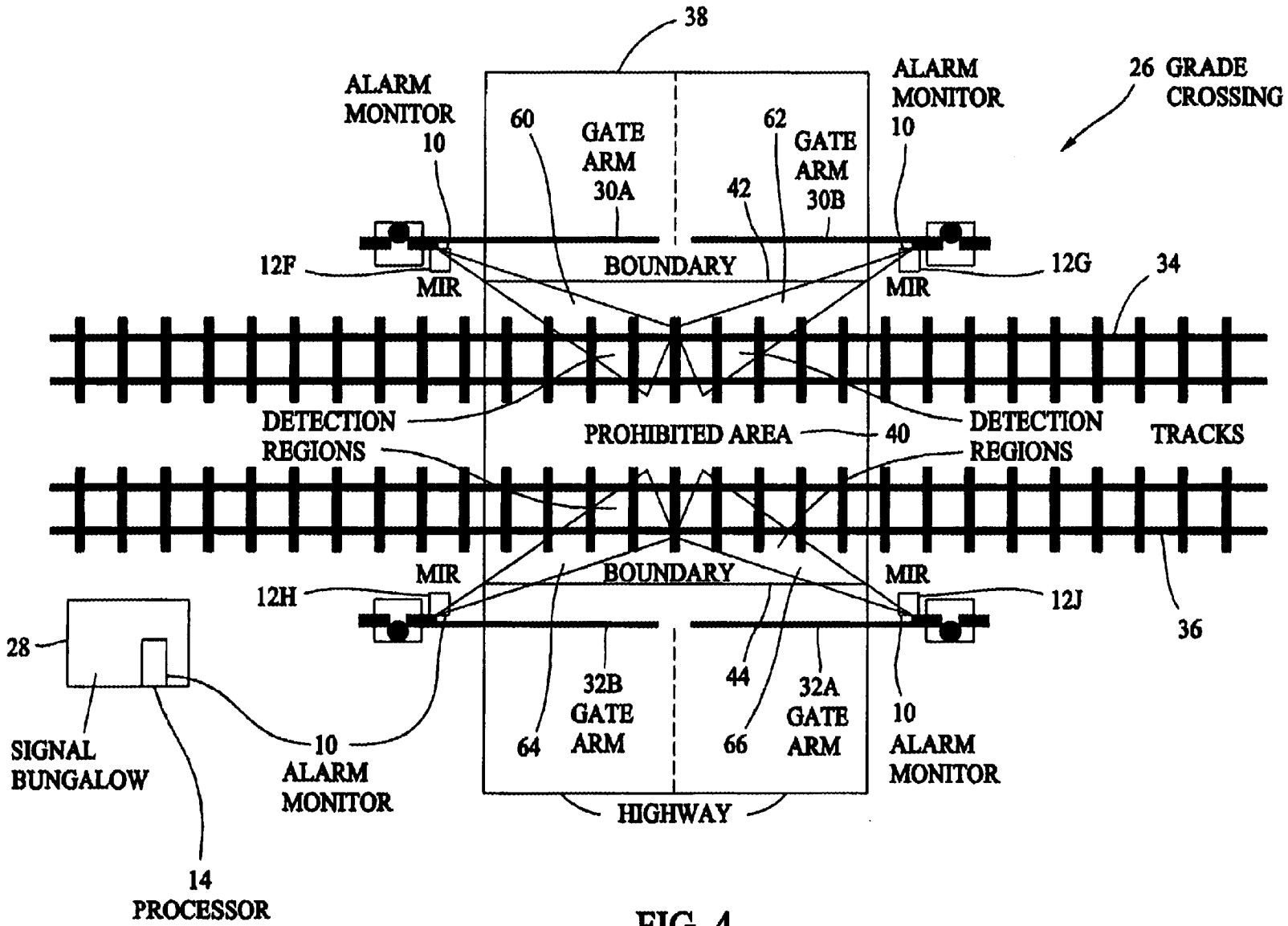
FIG. 4 is a simplified map of a railroad crossing having a four quadrant gate.

FIG. 4 is an illustration of an embodiment of alarm system mounted on a railroad crossing 26 in a manner similar to that shown in FIG. 3. The example of FIG. 4 differs in that railroad crossing 26 is provided with a four quadrant gate having four gate arms 30A, 30B, 32A, and 32B, where gate arms 30A and 32A are entrance gate arms and gate arms 30B and 32B are exit gate arms. Interference with detection regions 60, 62, 64 and 66 of MIR units 12F, 12G, 12H and 12J by gate arms 30A, 30B, 32A, and 32B is minimized because MIR units 12F, 12G, 12H and 12J are configured to have limited range and well-defined and delimited detection coverage.

Figure 5:
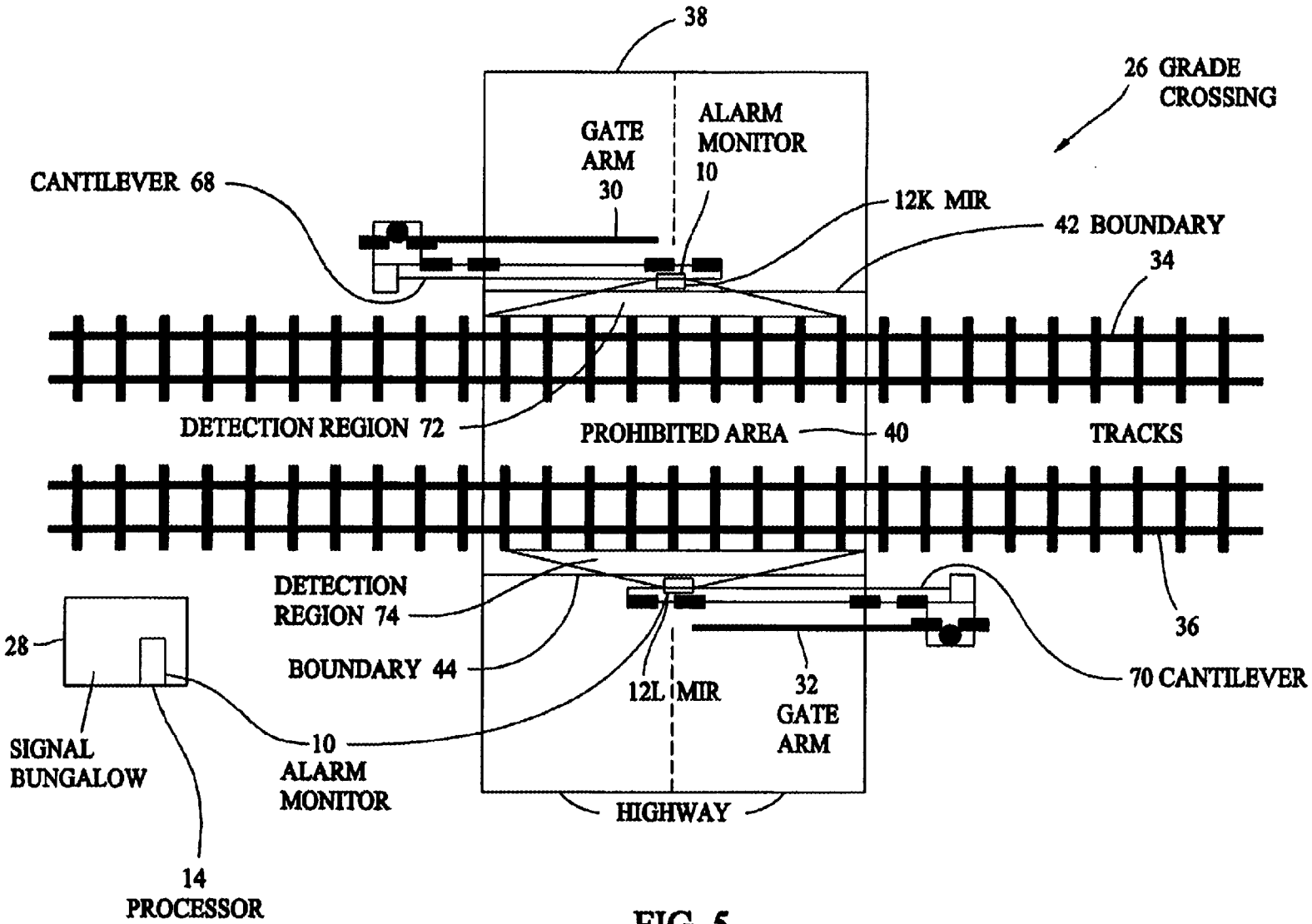
FIG. 5 is a map of a railroad crossing similar to that of FIG. 2, but having cantilevers cross over a portion of a highway near prohibited edge boundaries.

The embodiment illustrated in FIG. 5 is similar to that shown in FIG. 2, except that in FIG. 5, MIR units 12K and 12L are mounted on cantilevers 68 and 70 that cross above a portion of highway 38 near prohibited area 40 boundaries 42, 44, respectively. Also, MIR units 12K and 12L are configured to have broad, but limited distance, detection regions 72 and 74 directed towards highway 38 from cantilevers 68 and 70, respectively.

The use of MIR technology by the various embodiments herein described renders the alarm monitor impervious to rain, snow and dust, and allows it to operate in a very precise manner, maintaining very sharply defined detection zones and boundaries over a wide range of environmental extremes. In embodiments in which the island activation relay is also monitored, the alarm monitor makes accurate determinations that the warning system is activated and that an object is present where it should not be. Advantageously, in some embodiments, signals from the MIR unit are superimposed on the power conductors that supply the lights and gates with their electrical energy or transmitted via radio, so that the requirement for additional wiring that might be exposed to the elements or have to be buried is minimized.

It is apparent that the embodiments described herein provide a cost-effective system for detecting and reporting instances of vehicles and pedestrians violating crossing warning systems. Using these embodiments, coupled with communications techniques as described below, railroad industry and federal/state transportation authorities can learn of elevated risk situations at railroad crossings without waiting to compile accident statistics. With such information, better decisions can be made with respect to increased enforcement, implementation of alternate warning systems, or other remedies to reduce the likelihood of accidents. In one embodiment, multiple railroad crossings which implement the MIR alarm monitoring systems above described, communicate with a central location. From the central location, automatic surveys of the railroad crossing can be accomplished which in turn identify the railroad crossings which pose elevated risk to pedestrian and vehicular traffic. Such a system is desirable as known methodologies for increasing the safety of railroad crossings are reactive, that is in response to one or more railroad crossing accidents. In one such embodiment, each railroad crossing processor 14 (shown in FIG. 1) is configured to communicate with a cellular network.

In a specific embodiment, processor 14 is embodied in a device called a remote terminal unit (RTU) (not shown). An RTU is configured with multiple digital inputs, analog inputs, and digital outputs which are coupled to processor 14, and is therefore capable of interfacing with one or more MIR units and other monitoring and safety equipment that is installed at a railroad crossing. In one embodiment, the above described outputs and inputs incorporate optically isolated circuitry and therefore are capable of withstanding the extreme conditions found at rail crossings which do not include signal bungalows 28 (shown in FIG. 2). Other features of the RTU include internal status and notification alarming capability, RTU operational status indication, and communication link status indication. The RTU further includes a standby battery capability and optionally may include a solar power feature.

In another embodiment, RTUs are configured to communicate over a cellular control channel. As all communications from the RTU are in a digital format, reliable communication is ensured in areas where voice cellular coverage is marginal. Cellular control communications are desirable as railroad monitoring and tracking applications only small amounts of alarm, status, and survey information to be transported. It has been found that ongoing operational costs of private radio or switched telephone, cellular or wired are prohibitive for such applications.

Figure 6:
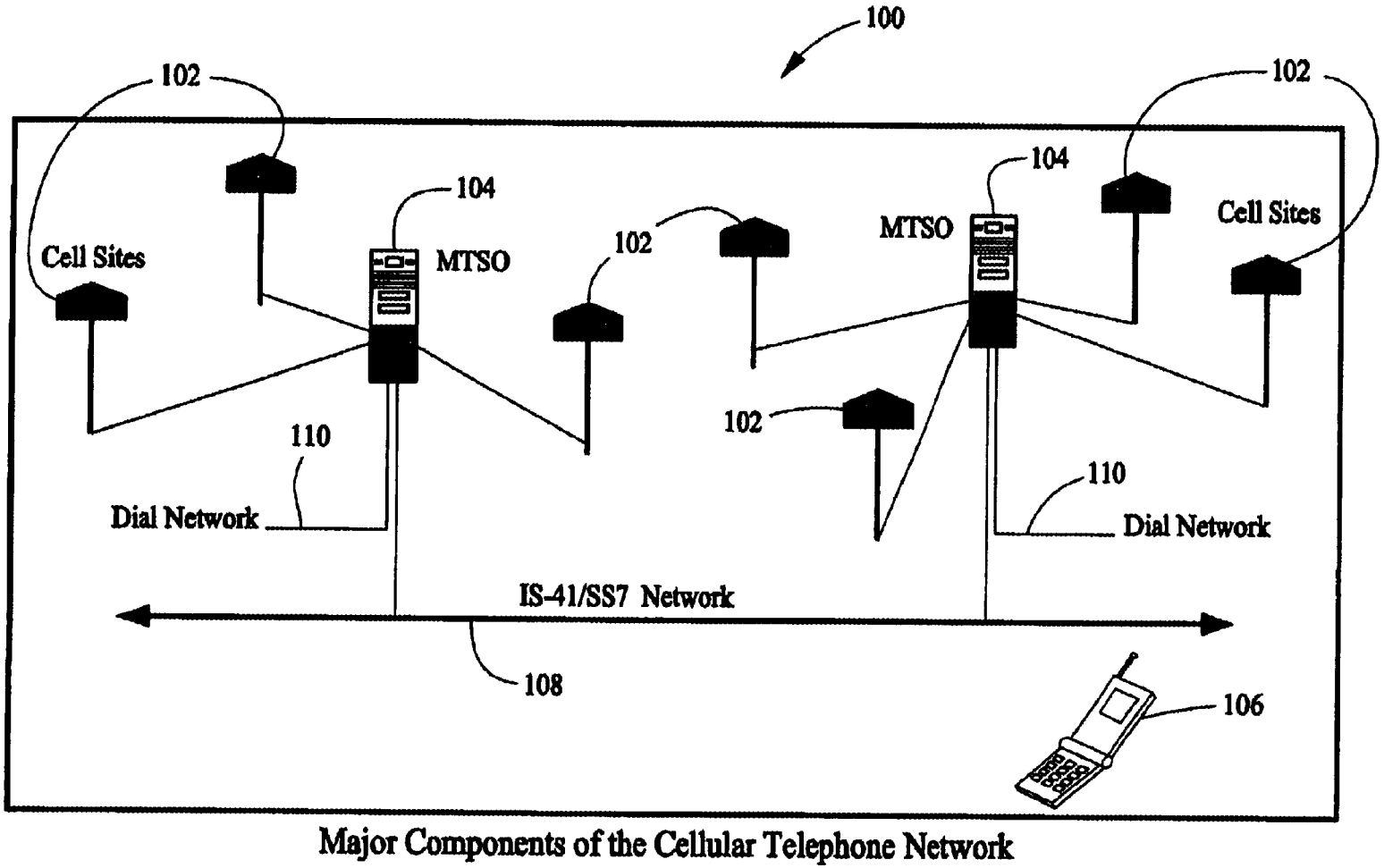
FIG. 6 is a diagram of a cellular telephone network.

Cellular control channel communications use an underutilized component of existing cellular telephone networks. A diagram of such a network 100 is shown in FIG. 6. Network 100 typically includes multiple cell sites 102 or towers, a plurality of which are communicatively coupled to a mobile telephone switching office (MTSO) 104. Typical cellular networks, similar to network 100, may include multiple MTSOs 104, each communicating with multiple towers 102. Cell sites 102 transmit and receive signals to and from the individual cellular telephones 106 within a service area of the cell sites 102. The number of cell sites 102 per MTSO 104 varies according to geography and other factors. Each MTSO 104 is configured to interface to a network 108. Network 108 is, in one embodiment, an IS 41/SS7 network. Each MTSO 104 further interfaces to a local dial network 110.

Control channel communication is optimized for the transport of small packets of information over vast geographic areas at an extremely low cost. Advantages of control channel communication include that such communications utilize an existing network, utilizing proven technology, accessible in even the most remote areas. In addition, there are no capital equipment outlays necessary to establish the wide area network, no cellular telephone dialing occurs, so there are no monthly telephone line or cellular fees, and there are no ongoing support or maintenance costs to support the wide area network.

In known cellular networks, each cellular provider uses approximately 5% their assigned channels as control channels. The channels within the 5% are digital and are not used for voice conversations. Rather, the control channels are used solely for communicating administrative information to and from the cellular telephones in a service territory.

One known control channel communication protocol requires that each message be duplicated 5 times during each 125 msec transmission sequence, and that 3 out of 5 messages be identical for acceptance. Information delivered using the cellular control channels is also transmitted at a proportionally higher power than voice channels. During voice conversations, the cell site through which a cellular telephone is communicating is instructing the cellular telephone to reduce its power to the minimum necessary to achieve communications with that cell. The reduction in power allows reuse of the frequency at other cell sites. However, control channel power is not reduced, assuring geographical coverage even in marginal, fringe areas of voice coverage.

Figure 7:
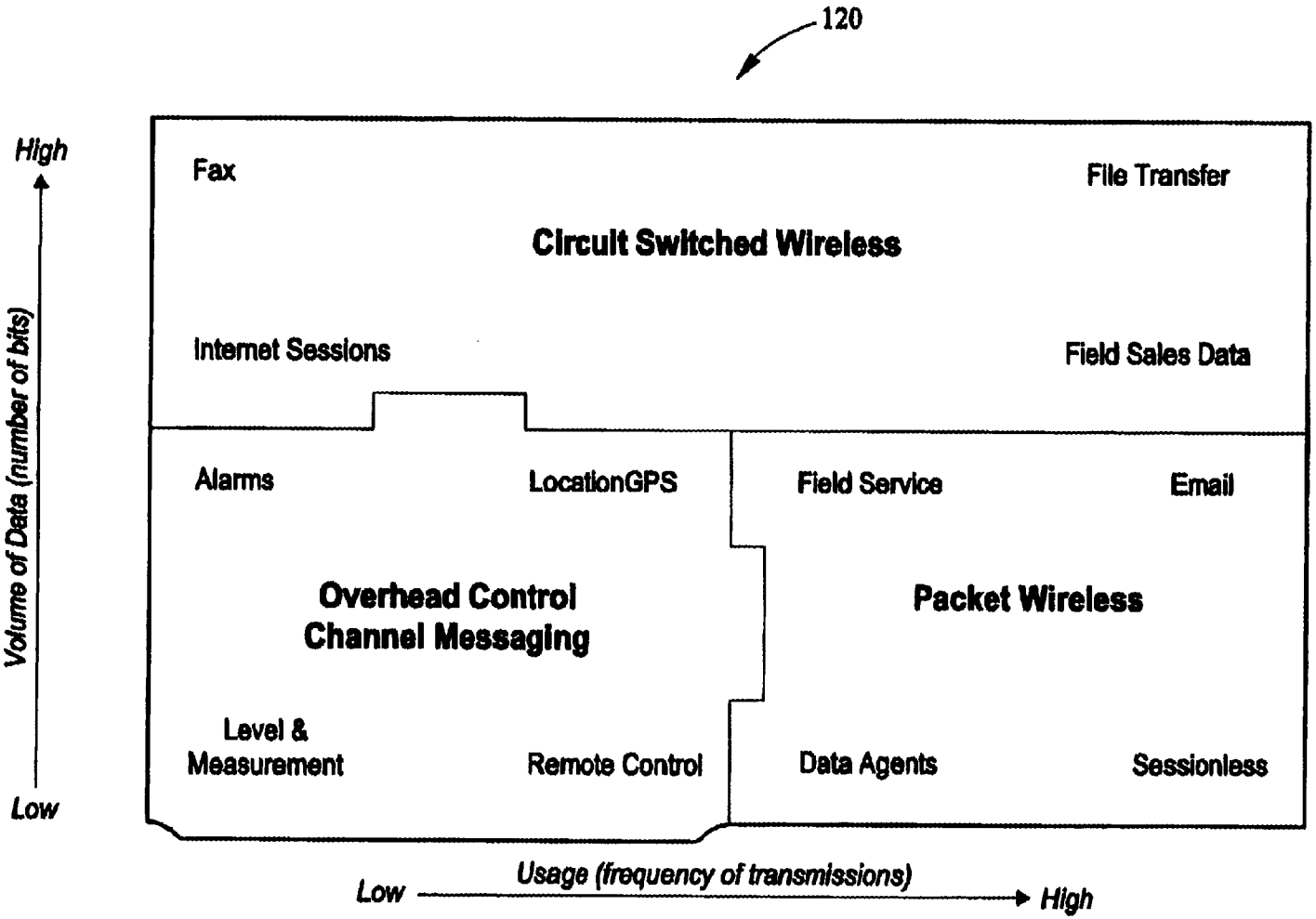
FIG. 7 is a graph charting communication types by volume of data against frequency of transmissions.

While a particular cell system may be saturated with voice calls, the control channels are still relatively available, and each one is able to process 36,000 message packets per hour. FIG. 7 is a graph 120 charting communication types by volume of data against frequency of transmissions. Chart 120 shows that control channel communications has a low volume of data and relativity low update rates.

Even at the busiest times, control channels are operated at less than 25% capacity. The control channels provide many pieces of information to and from cellular telephones, using a forward channel and a reverse channel. Information is sent over forward control channels (FOCC) to instruct cellular telephones how to operate in a given service territory, identify the local system, and initiate the ringing, or paging, of cellular telephones. Reverse control channels (RECC) send dial requests and ring responses from the cellular telephones to the system along with roaming registration requests. Two functions performed by the control channels are used within the cellular RTUs, RECC Roaming Registration and FOCC Paging.

RECC Roaming Registration

Figure 8:
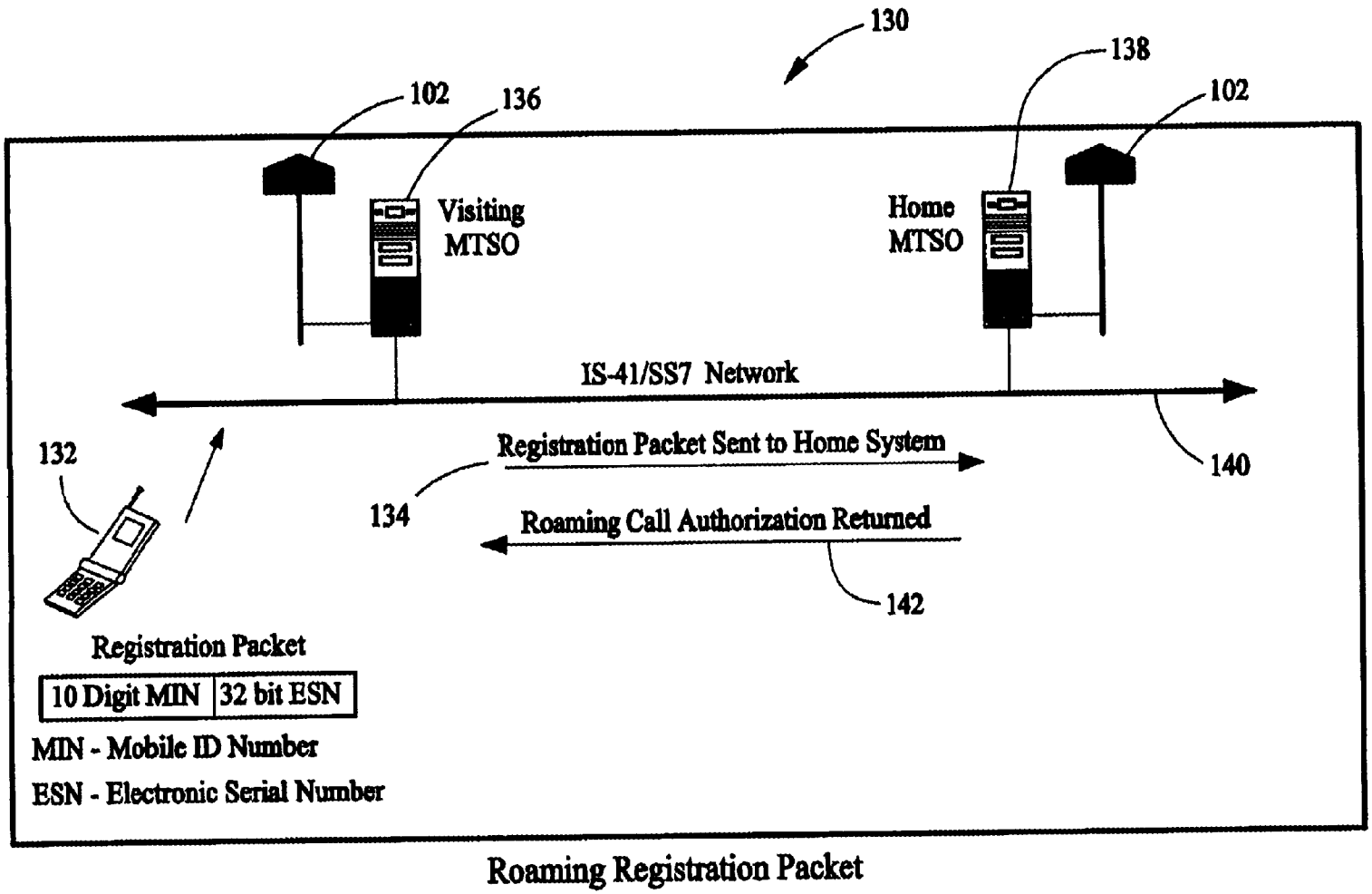
FIG. 8 is a diagram showing roaming registration for a cellular telephone.

When a cellular telephone enters a non-home area, forward channel information from the nearest cell site identifies what system the phone has entered, using a System ID (SID). FIG. 8 is a diagram 130 showing roaming registration for a cellular telephone 132. Cellular telephone 132 is programmed with a home SID, and when telephone 132 recognizes that it is in a non-home area, telephone 132 automatically attempts to register itself for use in that service territory by sending a roaming registration packet 134 comprised of two pieces of information—a MIN (Mobile Identification Number) and an ESN (Electronic Serial Number) for the telephone. The MIN is the 10 digit telephone number of cellular telephone 132, and the ESN of telephone 132 is established at the time of cellular telephone manufacture.

Roaming registration packet 134 is received by the local cell at a visiting MTSO 136, which looks at the MIN to determine an SID of cellular telephone 132. MTSO 136 then instantly routes that registration packet back to the home MTSO 138, based upon received SID, over IS-41 network 140. Home mobile telephone switching office (MTSO) 138 is configured to look up account information and sends back a message 142 over IS-41 network 140 telling visiting MTSO 136 whether or not calls to be placed from cellular telephone 132 in that service territory (MTSO 136) should be allowed. Data exchange for packet 140 and message 142, takes less than ten seconds.

FOCC Paging

When a call is placed to a cellular telephone, the system sends out what is referred to as a page, the MIN or telephone number of the cellular telephone, over a Forward Control Channel (FOCC). If the call is answered by the cellular telephone, a page response is sent back and a voice channel is then assigned so that the conversation sequence may commence. Once on a voice channel the conversation never uses the control channels again. Cell and channel hand-offs are accomplished over the voice link, keeping the control channel free to process call initiation functions.

Remote Terminal Unit (RTU) Use of Control Channels for Third-Party Messaging

By emulating the FOCC and RECC functions, third party information packets may be sent through existing cellular networks, allowing communication of data to occur virtually anywhere. As described below, a gateway is provided through which these information packets, also referred to as datagrams, are routed outside the cellular telephone network, to client-side information servers.

In one embodiment of an RTU, the functional equivalent of a cellular telephone without keyboard, display, and audio circuitry is embedded. When alarm and status data are to be sent, the RTU transmits a packet of information to the closest cellular telephone tower 102 (shown in FIG. 6). This information packet looks exactly like a registration packet to the existing cellular system. In the MIN field is the RTU's telephone number, one of several million numbers that are not used by wireless cellular, paging, or wireline services. In the electronic serial number (ESN) field of the registration packet is the alarm and status information. This information is received by the cellular network in the same way that a roamer registration request packet is received. However, instead of routing the packet to a distant home SID, the cellular network routes the alarm and status information through a gateway to at least one computer, in one embodiment a server, where it is placed into a portion of a database reserved for use and access by a particular client.

Using the above described wireless wide area cellular network, alarm, status, and survey data from rail crossings are reliably delivered from remote locations and, in one embodiment, directly into an Internet Web Page. Other client-side delivery methods are also available including automated e-mail, facsimile, pager, telnet, and Private Virtual Circuit (PVC) Frame Relay links into existing Intranet applications. Therefore rail crossing monitoring applications that have not been able to economically justify conventional communications techniques are brought on line and are fully accessible over the Internet.

Figure 9:
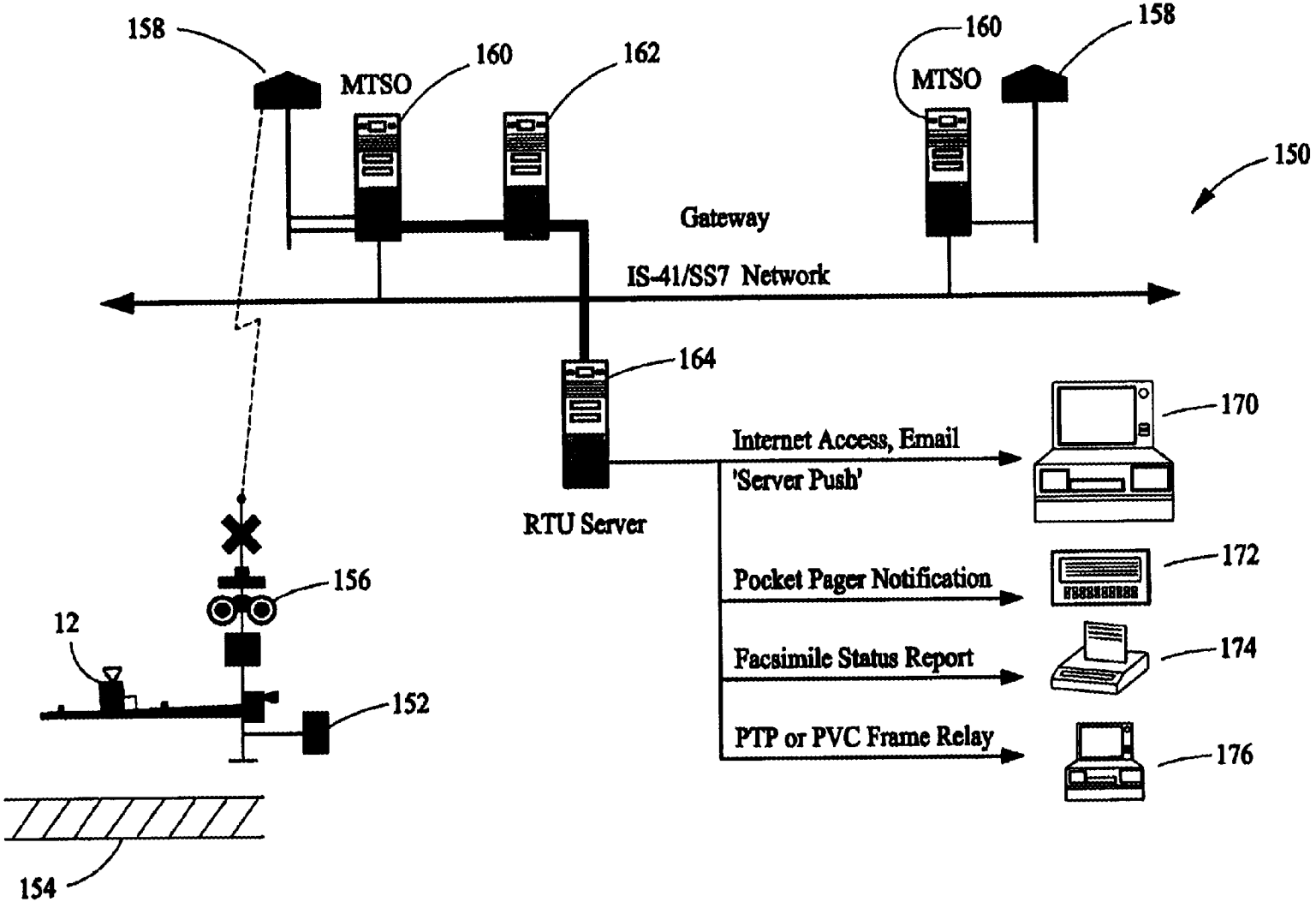
FIG. 9 is a diagram of a control channel communication based rail crossing monitoring system.

FIG. 9 is a diagram of a control channel communication based rail crossing monitoring system 150. System 150 includes a RTU 152 which is connected to a MIR unit 12 (also shown in FIGS. 1–5) at a railroad crossing 154. Any number of RTU 152 and MIR unit 12 arrangements are possible at railroad crossing 154, as shown and described in FIGS. 2–5. In one embodiment, RTU 152 and MIR unit 12 are configured for detection and tracking of a number of rail crossings by pedestrians and vehicles, in one or both of gate alarm 156 activated and not activated conditions. In such an embodiment, RTU 152 is configured to periodically transmit data packets which include MIR detection data (e.g. a number of rail crossings, also referred to as detection counts) and any other pertinent information, in a digital format, to cellular tower 154. Rail crossing data received at tower 158 is propagated to mobile telephone switching office (MTSO) 160, where, based upon identification information contained within the data packets, the rail crossing data is transferred via a gateway 162 to RTU server 164, in one embodiment, via the Internet.

Railroad companies, or in an alternative, companies contracted to the railroads or a governmental agency, are able to access the information received from RTU 152 via any one of internet access/E-mail 170, pocket pager 172 notification, facsimile 174, and PTP or private virtual circuit (PVC) frame relay 176. Although not shown, multiple RTUs 152, at multiple railroad crossings, are able to transmit data packets to towers 158, thereby providing a railroad or governmental agency with an ability to data track and log the multiple railroad crossings against one another. A system, such as system 150 allows finite resources, for example, VITAL safety equipment, to be installed or reassigned to those rail crossings within a rail system where the largest benefit can be accrued, presumably those crossings with the largest crossing volume or those crossings with the largest volume of crossings during an alarm period.

Figure 10:
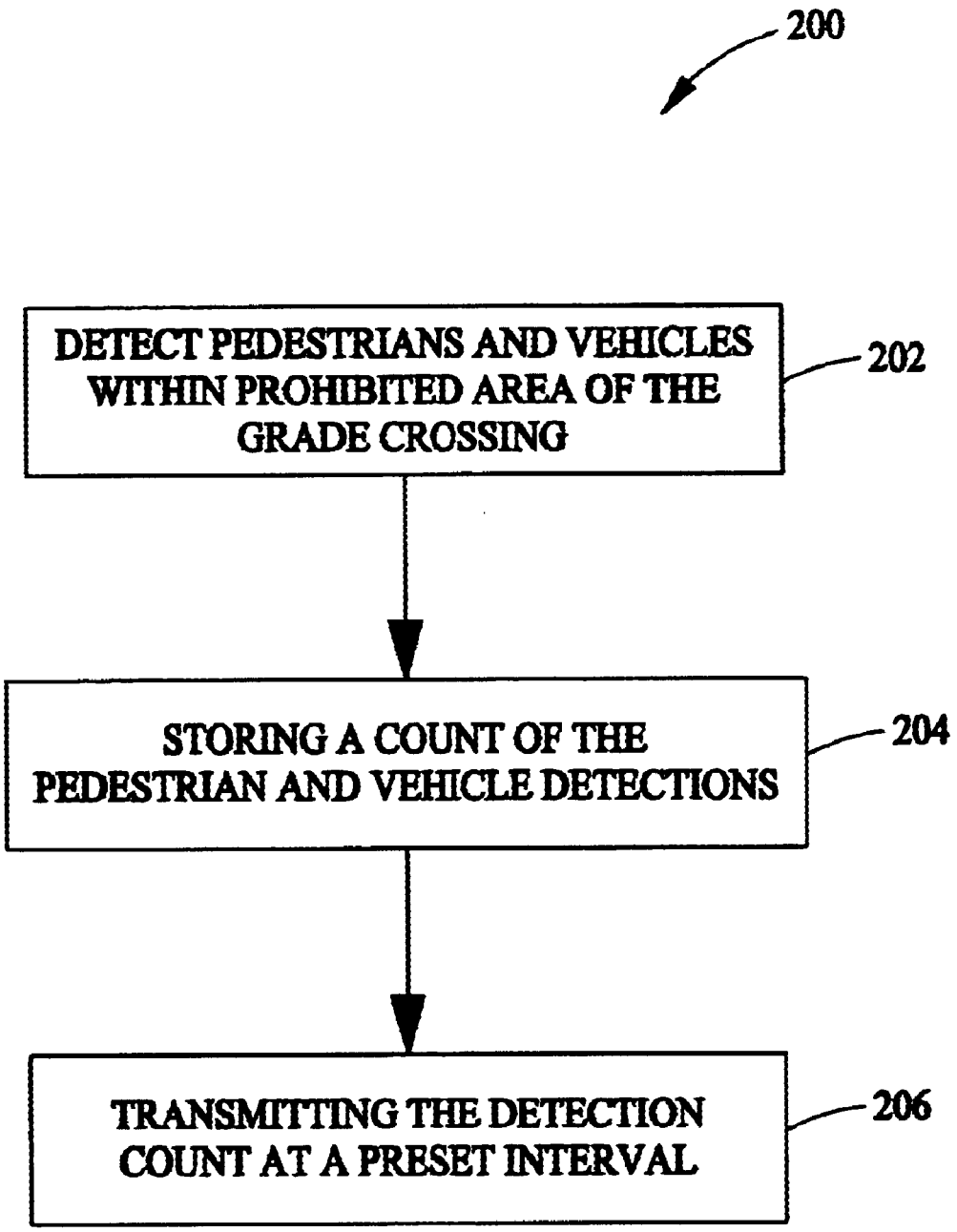
FIG. 10 is a flow chart for an example method for monitoring pedestrian and vehicle traffic at a railroad crossing.

FIG. 10 is a flowchart 200 which describes one method for monitoring and tracking a railroad crossing for pedestrian and vehicle traffic. implementing MIR units and RTUs communicating on a cellular control channel as described above. First, vehicles and pedestrians are detected 202 within a prohibited area of the railroad crossing. The detections within the railroad crossing are counted and stored 204. At a preset interval, the detection counts are transmitted 206, for example, to a collection device. In specific embodiments, such a collection device may collect detection count data for a plurality of railroad crossings.

In one specific embodiment, a MIR unit detects vehicles and pedestrians within the railroad crossing. An RTU with an input to which the MIR unit is coupled, is configured to count the detections and store a detection count. The RTU is programmed with a period, or preset interval, at which time the RTU will transmit railroad crossing data (i.e. the detection counts). The RTU may store the detection counts as detection count data based upon other criteria. For example, the detections may be separately stored by the RTU as being detections which occurred while the railroad crossing was activated, for example, when a train was approaching, or alternatively as unactivated detections, when no train activity was present. Further, RTUs may be configured to store a time for each stored detection.

In one specific embodiment of a railroad crossing system, at the programmed interval, the RTU transmits detection count data, over a cellular control channel, to a tower 158 (shown in FIG. 9) which propagates the data to a mobile telephone switching office 160 (shown in FIG. 9). Detection counts are then transferred from mobile telephone switching office 160 to gateway 162 (shown in FIG. 9), which is connected to a computer. In one embodiment, the computer is a server, such as server 164 (shown in FIG. 9). The detection count data is transferred from gateway 162 to server 164. In one embodiment, server 164 is an internet server. In such an embodiment, server 164 is accessed by a user to retrieve detection count data. In one exemplary embodiment, detection count data is loaded into files in the server which are displayable to a user as web pages (described below).

Figure 11:
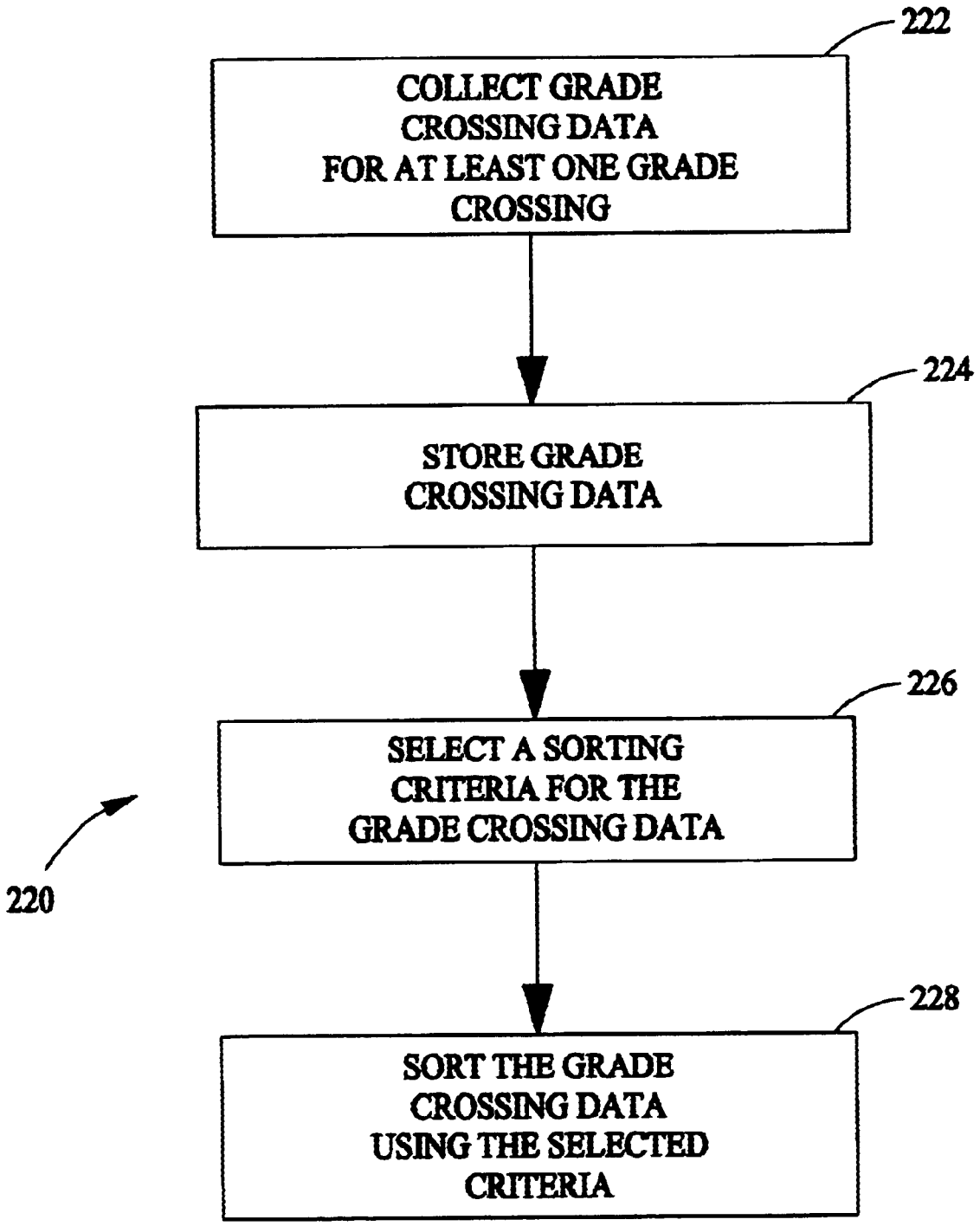
FIG. 11 is a flowchart for an example method for using collected and stored railroad crossing data to identify elevated risk railroad crossings.

FIG. 11 is a flowchart 220 which illustrates a method for monitoring a plurality of railroad crossings in order to identify elevated risk railroad crossings. Using a device, such as server 164 railroad crossing data is collected 222 and stored 224 for at least one railroad crossing. After storing 224 the railroad crossing data from the multiple railroad crossings, for example, collecting such data from one or more RTUs, a sorting criteria is selected 226. Railroad crossing data is then sorted 228 for the multiple crossings according to the selected criteria. In one specific embodiment, railroad crossing data is sorted according to the number of detections at a railroad crossing. Comparatively higher numbers of vehicle and pedestrian detections within a railroad crossing are used to identify those railroad crossings with an elevated risk. Identification of such elevated risk crossings allow a railroad or governmental entity to deploy or upgrade railroad crossing safety equipment, which are limited resources, in the places where those resources are most needed.

Figure 12:
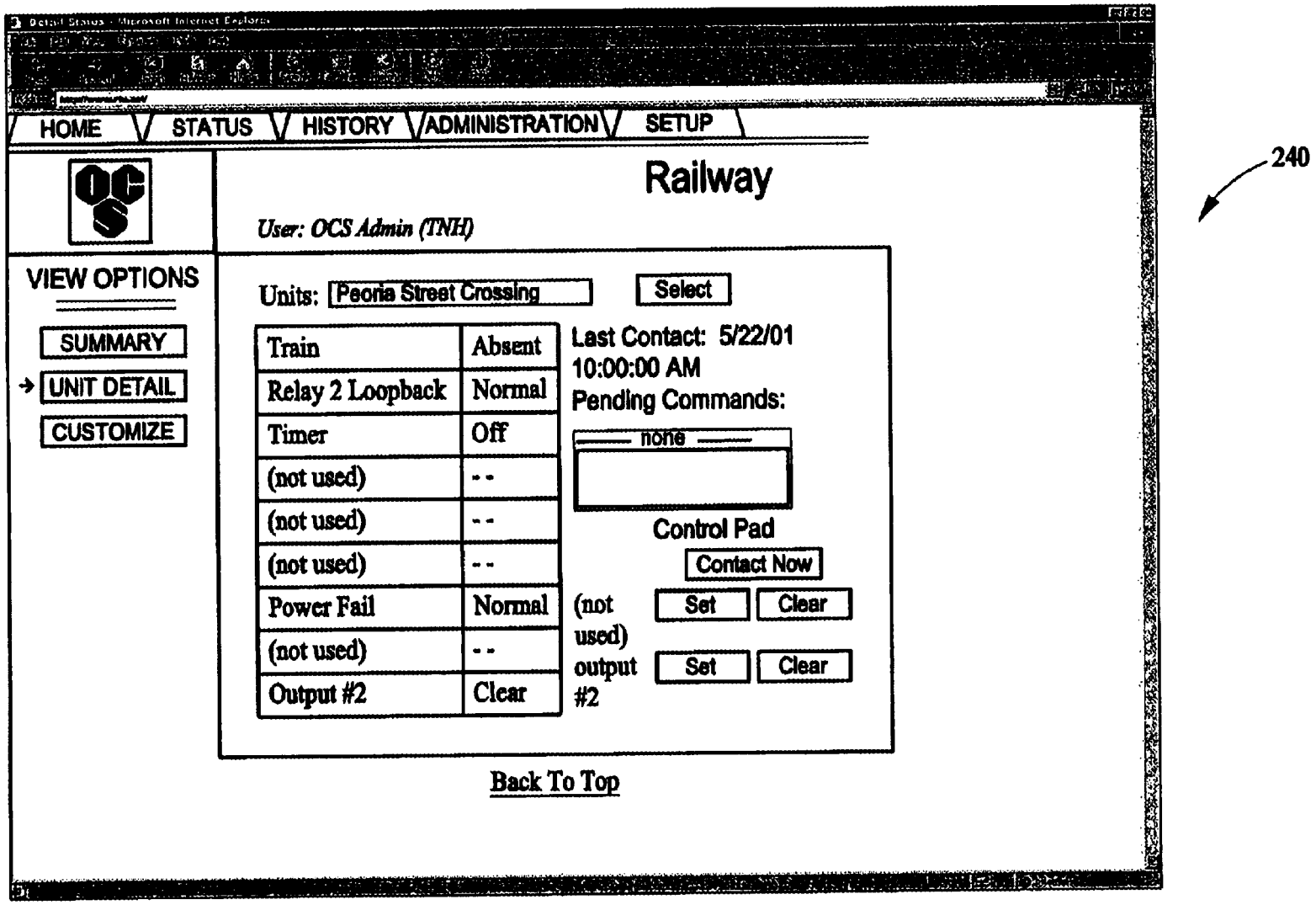
FIG. 12 is one embodiment of a railroad crossing data web page.

FIG. 12 is one embodiment of a web page 240 where a user can access railroad crossing data. Page 240 indicates a status of one particular railroad crossing at a particular time and includes, whether a train is present, and status information of an RTU, for example, whether there has been a power failure to the power source for the RTU. Page 240 is but one example of web pages that are used to gather data from, and change operating parameters for one or more RTUs. Specifically, one web page (not shown) is used to update a transmission rate of railroad crossing data from an RTU, for example, from once an hour to once every half-hour. In addition, web pages (not shown) are used to combine data that has been received from multiple RTUs to track and quantify activities, for example, railroad crossings while an alarm is activated, at one or more railroad crossings. Such tracking and quantification allows railroads and governmental entities to identify which railroad crossings need safety improvements from a proactive perspective, rather than the traditional reactive methods.

Figure 13:
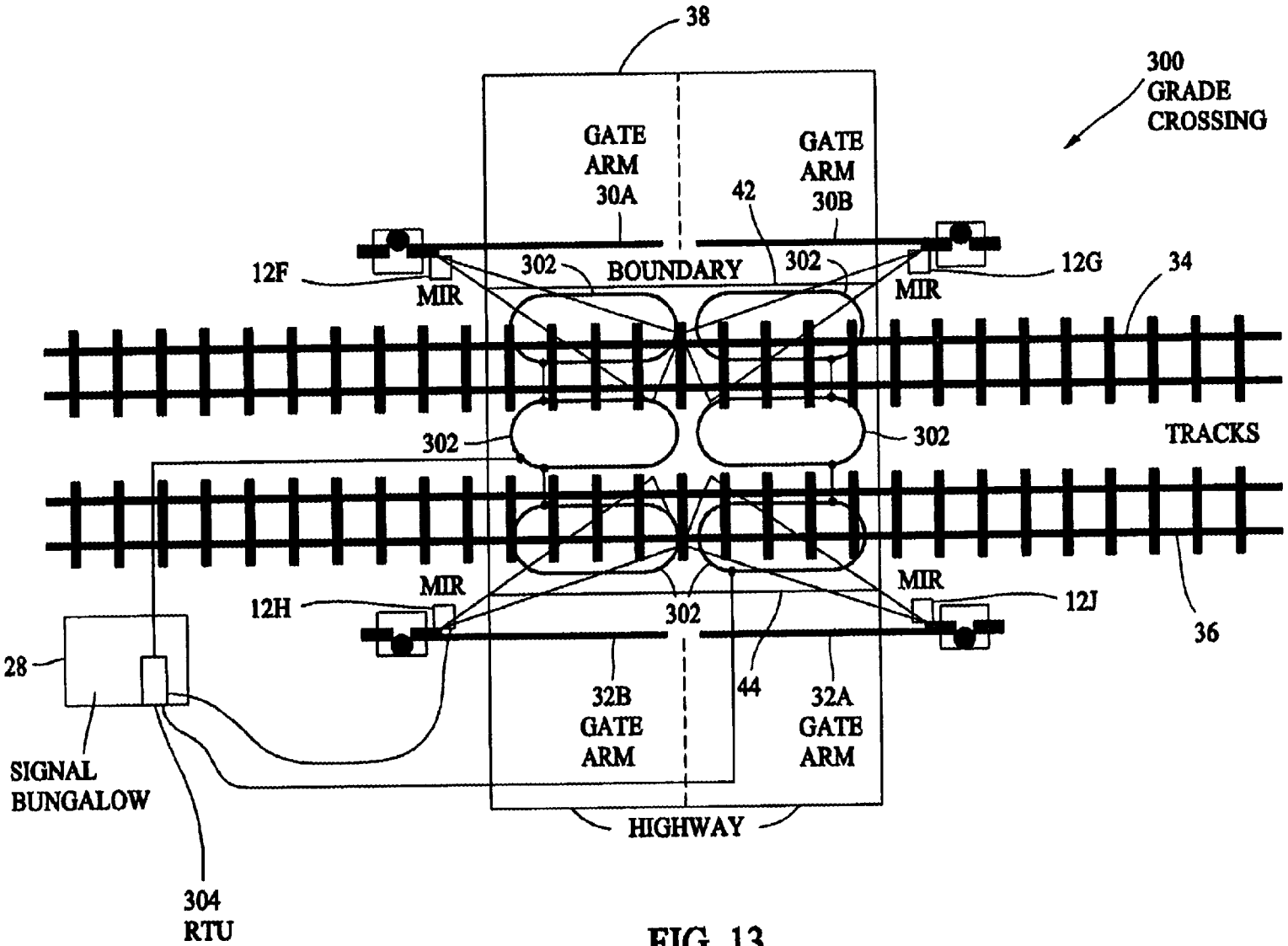
FIG. 13 is a map of a railroad crossing including a micropower impulse radar system to augment a buried impedance loop system.

FIG. 13 is one embodiment of a railroad crossing 300 similar to railroad crossing 26 shown above in FIG. 4, wherein railroad crossing 300 is provided with a four quadrant gate having four gate arms 30A, 30B, 32A, and 32B, where gate arms 30A and 32A are entrance gate arms and gate arms 30B and 32B are exit gate arms. Such railroad crossing are sometimes referred as four quadrant gate crossings. Four quadrant gate crossings are used in high traffic area railroad crossings and are thought to prevent drivers from driving around gate arms which sometimes happens when railroad crossings are outfitted with a double gate arm configuration, that is, one gate arm per each railroad crossing approach. With such a configuration, slower crossing vehicles may sometimes become trapped between gate arms if the railroad crossing becomes activated due to the approach of an oncoming train. The four quadrant gate arms to do not provide an easy exit path for the vehicle that is between the activated gate arms. Four quadrant railroad crossings are sometimes configured with buried impedance loops 302 which are connected to a gate control mechanism (not shown). Impedance loops 302 are used for detection of vehicles within boundary 42 of railroad crossing 300. Upon detection of a trapped vehicle, the gate control mechanism is configured to cause the gate arms to open, allowing the trapped vehicle to exit the area bordered by boundary 42. However, impedance loops 302 are costly to maintain and install, and further degrade over time as passing trains exert a large amount of force on the buried loops. Further, there are no known failsafe modes for impedance loop technology. In addition, weather conditions, for example, rain, ice and snow can adversely affect operation of buried impedance loops 302.

To augment the buried loops and control mechanism, railroad crossing 300 includes at least one remote terminal unit 302 which is connected to, or in communication with MIR units 12F, 12G, 12H and 12J as described above. MIR technology is utilized to augment buried impedance loops 302 to provide either of a backup for the impedance loop technology, or a first sensor for the detection of trapped vehicles. In one embodiment, RTU 304 is configured to interface with the control mechanisms that control gate arms 30A, 30B, 32A, and 32B. In another embodiment, RTU 304 is configured as the gate control mechanism.

In yet another embodiment, a four quadrant gate crossing is configured with impedance loops and MIR units which are connected to control channels within the control mechanisms and RTUs respectively, such that upon detection of a trapped vehicle, only the entrance gate arm and the exit gate arm, for example, 30A and 30B, for that traffic lane where the detection occurred, are raised for vehicle detection. In still another embodiment, only an exit gate arm is raised. Such embodiments allows trapped vehicles to exit while helping to prevent other vehicles from entering boundary 42. Augmenting a gate crossing with MIR technology provides a low maintenance, low cost safety solution for gate crossing 300, either as backup for buried impedance loops 302 or as a prime sensor for trapped vehicles. Of course, the MIR unit and RTU systems described within are configurable for gate crossings which are not four quadrant gate crossings, for example, gate crossings which use single arms (shown in FIGS. 2 and 5).

While the invention has been described in terms of various specific embodiments, those skilled in the art will recognize that the invention can be practiced with modification within the spirit and scope of the claims.

What is claimed is:

1. A method for collecting railroad crossing data, comprising:

detecting a presence of at least one of pedestrians and vehicles within a boundary of the railroad crossing;

storing a count of the detections of the at least one of pedestrians and vehicles within the boundary;

transmitting the count to an external device using a cellular control channel; and determining a risk for the railroad crossing based upon the count of the detections.

2. A method according to claim 1 wherein a presence of the pedestrians and the vehicles are detected using a micropower impulse radar (MIR) unit.

3. A method according to claim 2 wherein the count is stored in a remote terminal unit connected to the MIR unit.

4. A method according to claim 3 wherein the remote terminal unit is configured to communicate over a cellular control channel.

5. A method according to claim 1 wherein transmitting the count comprises at least one of transmitting the count at a preset interval and polling for a transmission of the count.

6. A method for collecting railroad crossing data, comprising:

detecting a presence of at least one of pedestrians and vehicles within a boundary of the railroad crossing;

storing a count of the detections of the at least one of pedestrians and vehicles within the boundary;

transmitting the count to a mobile telephone switching office using a cellular control channel;

transferring the count from the mobile telephone switching office to a gateway;

transferring the count from the gateway to a server; and accessing the server.

7. A method according to claim 6 wherein accessing the server comprises accessing a web page.

8. A method according to claim 6 wherein accessing the server comprises at least one of receiving E-mail notification, pocket pager notification facsimile reports, and Private Virtual Circuit (PVC) Frame Relay links.

9. A railroad crossing system, comprising:

at least one micropower impulse radar (MIR) unit configured to detect a presence of at least one of pedestrians and vehicles within a boundary of a railroad crossing;

a remote terminal unit (RTU) coupled to said MIR, said RTU configured to store a count of the detections of the at least one of pedestrians and vehicles within the boundary by said MIR unit and further configured to communicate the counts, said RTU comprising at least one of a standby battery capability and a solar power feature; and a computer system configured to receive the counts communicated by said RTU.

10. A railroad crossing system according to claim 9 wherein said RTU is configured to communicate on a control channel of a cellular network, said system further comprising a cellular system configured to receive communications on the cellular control channel from said RTU, said cellular system comprising:

at least one cellular tower;

a mobile telephone switching office (MTSO) connected to said towers; and a gateway connected to said MTSO and connected to said computer system.

11. A railroad crossing system according to claim 10 wherein said computer system comprises a server configured to retrieve monitoring and tracking data from said cellular system.

12. A railroad crossing system according to claim 11 wherein said server is an internet server.

13. A railroad crossing system according to claim 11 wherein said server is configured to provide at least one of internet access, E-mail notification, pocket pager notification, facsimile reports, and Private Virtual Circuit (PVC) Frame Relay links.

14. A railroad crossing system according to claim 11 wherein said server is configured with at least one web page for display of railroad crossing monitoring and tracking data.

15. A railroad crossing system according to claim 9 wherein said RTU comprises at least one of at least one digital input, at least one analog input, at least one analog output, internal status and notification alarming capability, an operational status indication and communication link status indication.

16. A railroad crossing system according to claim 9 wherein said RTU is configured to store separate detection counts for inactive railroad crossing detections and active railroad crossing detections.

17. A railroad crossing system according to claim 9 wherein said RTU is configured to store a time for each stored detection.

18. A method for monitoring a plurality of railroad crossings comprising:

collecting railroad crossing data for each railroad crossing;

storing the railroad crossing data;

selecting a sorting criteria; and sorting the railroad crossing data using the selected sorting criteria, wherein collecting railroad crossing data comprises determining at least one of a number of the pedestrians that have crossed the railroad crossing when the crossing was active, a number of the pedestrians that have crossed the railroad crossing when the crossing was inactive, a number of the vehicles that have crossed the railroad crossing when the crossing was active, and a number of the vehicles that have crossed the railroad crossing when the crossing was inactive.

19. A method according to claim 18 wherein railroad crossing data is collected at predetermined intervals.

20. A method according to claim 18 wherein sorting the railroad crossing data comprises identifying elevated risk railroad crossings based upon a number of the pedestrians and the vehicles that have crossed the railroad crossing.

21. A method according to claim 18 wherein identifying elevated risk railroad crossings comprises identifying railroad crossings with the largest number of the pedestrians and the vehicles crossing the railroad crossing while the crossing is active.

22. A system comprising:

at least one computer;

a plurality of micropower impulse radar (MfR) units, at least one MIR unit per railroad crossing, for a plurality of railroad crossings, said MIR units configured for detecting a presence of at least one of pedestrians and vehicles within a boundary of the railroad crossing where deployed;

a plurality of remote terminal units (RTUs), each of said MIR units connected to one of said RTUs, said RTUs configured to store a count of the presence of the pedestrians and vehicles detected within the boundary by said MIR units and further configured to communicate at least the counts to said computer, said computer configured to determine elevated risk railroad crossings based upon the received counts from said plurality of RTUs.

23. A system according to claim 22 further comprising a cellular network, wherein to communicate with said computer, said RTUs are configured to communicate over said cellular network and said computer is coupled to said cellular network.

24. A system according to claim 23 wherein said cellular network comprises:

at least one cellular tower;

at least one mobile telephone switching office (MTSO) communicatively connected to said towers; and a gateway connected to said MTSO, said RTUs configured to transmit and receive signals from said towers, and said computer configured to be coupled to said gateway.

25. A system according to claim 23 wherein said RTUs are configured to communicate on a cellular control channel.

26. A system according to claim 22 wherein said computer is configured as a server.

27. A system according to claim 22 wherein said RTUs are configured to store railroad crossing data, railroad crossing data including, a count of at least one of the pedestrians and the vehicles, at predetermined intervals.

28. A system according to claim 22 wherein said RTUs are configured to communicate railroad crossing data, railroad crossing data including a count of at least one of the pedestrians and the vehicles, at predetermined intervals.

29. A system according to claim 22 wherein said computer is configured to send requests to said RTUs to transmit railroad crossing data to said computer, railroad crossing data including a count of at least one of the pedestrians and the vehicles.

30. A system according to claim 22 wherein said computer is configured to transmit instructions to said RTUs, to reconfigure operating parameters of said RTUs.

31. A railroad crossing system comprising:

at least one crossing gate arm;

a number of impedance loops buried under the railroad crossing;

a gate control mechanism connected to said impedance loops and configured to raise said crossing gate arms upon detection of one or more vehicles within a boundary by said impedance loops;

at least one micropower impulse radar (MIR) unit, said MIR units configured to detect a presence of the one or more vehicles within the boundary; and at least one remote terminal unit (RTU) connected to said MIR units, said RTUs configured to communicate with said gate control mechanism, said at least one MIR unit and said at least one RTU providing a backup system to said impedance loops and said gate control mechanism for control of said gate control mechanism.

32. A system according to claim 31 whereupon upon the detection of one or more vehicles by at least one of said MIR units, said RTU is configured to determine if said gate control mechanism has raised said gate crossing arms and further configured to command said gate control mechanism to raise said crossing gate arms if said arms have not been raised.

33. A system according to claim 31 wherein said gate control mechanism and said remote terminal unit are configured as a single unit.

34. A system according to claim 31 wherein said system comprises four crossing gate arms in a four quadrant configuration.

35. A system according to claim 34 wherein said remote terminal unit is configured to instruct said gate control mechanism to raise one of the four crossing gate arms to allow the vehicles to exit the boundary.

36. A method for detecting trapped vehicles within a boundary of a railroad crossing, the railroad crossing including impedance loops buried under the crossing, within the boundary, and connected to a gate arm control mechanism, which is further connected to one or more gate arms, the railroad crossing further including at least one micropower impulse radar (MIR) unit configured to detect the vehicles trapped within the boundary and at least one remote terminal unit (RTU) connected to the MIR units and further configured to communicate with the gate arm control mechanism, said method comprising:

(1) lowering the gate arms upon approach of a train, thereby defining the boundary of the railroad crossing;

(2) checking for vehicles trapped within the boundary using the impedance loops and gate control mechanism and separately with the MIR units and the RTU;

(3) raising the gate arms if one or more of the trapped vehicles are detected;

(4) repeating step (2) until none of the trapped vehicles are detected; and (5) lowering the gate arms.

37. A method according to claim 36 wherein checking for vehicles trapped within the boundary comprises configuring the MIR units and RTU as a backup system to the impedance loops and gate control mechanism.

38. A method according to claim 36 wherein for a railroad crossing configured with four quadrant gate arms, the RTU and the gate arm control mechanism are configured to lift one or more gate arms near the one or more trapped vehicles, thereby allowing the one or more trapped vehicles to exit the boundary while allowing no further vehicles to enter the boundary.

* * * * *

UNITED STATES PATENT AND TRADEMARK OFFICE

CERTIFICATE OF CORRECTION

PATENT NO. : 6,641,091 B1
DATED : November 4, 2003
INVENTOR(S) : Hilleary

It is certified that error appears in the above-identified patent and that said Letters Patent is hereby corrected as shown below:

Title page,
Item [57], ABSTRACT,
Line 1, delete “the a method” and insert therefor -- a method --.

Column 14,
Line 15, delete “including, a” and insert therefor -- including a --.

Column 15,
Line 11, between “for” and “vehicles” insert -- the --.

Signed and Sealed this

Sixteenth Day of March, 2004

JON W. DUDAS
*Acting Director of the United States Patent and Trademark Office*